US009022093B2

(12) United States Patent
Shia

(10) Patent No.: US 9,022,093 B2
(45) Date of Patent: May 5, 2015

(54) METHOD OF CASTING SEMI-LIQUID OR SEMI-SOLID IRON-BASED ALLOY AND DIE FOR CASTING

(75) Inventor: Yoshiaki Shia, Tokyo (JP)

(73) Assignee: Nippon Steel & Sumitomo Corporation, Tokyo (JP)

( * ) Notice: Subject to any disclaimer, the term of this patent is extended or adjusted under 35 U.S.C. 154(b) by 0 days.

(21) Appl. No.: 12/737,123

(22) PCT Filed: Jun. 15, 2009

(86) PCT No.: PCT/JP2009/060878

§ 371 (c)(1), (2), (4) Date: Dec. 9, 2010

(87) PCT Pub. No.: WO2009/151139

PCT Pub. Date: Dec. 17, 2009

(65) Prior Publication Data

US 2011/0088864 A1 Apr. 21, 2011

(30) Foreign Application Priority Data

Jun. 13, 2008 (JP) ..... 2008-155991

(51) Int. Cl.
*B22D 17/00* (2006.01)
*B22D 17/20* (2006.01)

(52) U.S. Cl.
CPC ..... *B22D 17/2007* (2013.01); *B22D 17/2038* (2013.01); *B22D 17/007* (2013.01); *Y10S 164/90* (2013.01)

(58) Field of Classification Search
CPC ..... B22D 17/2038
USPC ..... 164/33, 72, 113, 267, 149, 312, 900
See application file for complete search history.

(56) References Cited

U.S. PATENT DOCUMENTS

| | | | | | |
|---|---|---|---|---|---|
| 3,909,424 | A | * | 9/1975 | Clark | 508/121 |
| 3,978,908 | A | * | 9/1976 | Klaus et al. | 164/72 |
| 4,420,028 | A | * | 12/1983 | Nelson | 164/149 |
| 4,562,875 | A | * | 1/1986 | Ogoshi et al. | 164/72 |
| 5,154,839 | A | * | 10/1992 | Hanano | 508/175 |
| 5,388,631 | A | * | 2/1995 | Suganuma et al. | 164/72 |
| 5,776,866 | A | * | 7/1998 | Karaki et al. | 508/122 |
| 6,354,359 | B2 | * | 3/2002 | Perrella et al. | 164/149 |

(Continued)

FOREIGN PATENT DOCUMENTS

| | | |
|---|---|---|
| CN | 1805808 A | 7/2006 |
| JP | 63-303663 | 12/1988 |

(Continued)

OTHER PUBLICATIONS

JPO machine translation of JP 2007-136466, Jul. 6, 2007.*

(Continued)

*Primary Examiner* — Kevin E Yoon
(74) *Attorney, Agent, or Firm* — Kenyon & Kenyon LLP

(57) ABSTRACT

A method of casting a semi-liquid or semi-solid iron-based alloy, the method including: applying, to a part or to the whole of an uppermost surface of an inner surface of a die, a lubricating die-release agent in which particles including at least one selected from molybdenum disulfide, graphite, tungsten disulfide, boron nitride, chrome oxide and boric oxide are dispersed in a solvent; and thereafter casting by using the die.

5 Claims, 3 Drawing Sheets

(56) References Cited

U.S. PATENT DOCUMENTS

| | | | | |
|---|---|---|---|---|
| 6,432,886 | B1 * | 8/2002 | Reidmeyer | 508/114 |
| 6,786,271 | B2 * | 9/2004 | Ishiduka et al. | 164/72 |
| 6,810,941 | B2 * | 11/2004 | Tsuchiya et al. | 164/312 |
| 6,953,079 | B2 * | 10/2005 | Suzuki et al. | 164/267 |
| 2002/0157571 | A1 * | 10/2002 | Takeo et al. | 106/38.22 |
| 2007/0012415 | A1 * | 1/2007 | Tsuchiya et al. | 164/113 |

FOREIGN PATENT DOCUMENTS

| | | |
|---|---|---|
| JP | 07-303933 | 11/1995 |
| JP | 8-318356 | 12/1996 |
| JP | 9-216034 | 8/1997 |
| JP | 2001-232443 | 8/2001 |
| JP | 2004-114151 | 4/2004 |
| JP | 2006-205243 | 8/2006 |
| JP | 2007-136466 | 6/2007 |

OTHER PUBLICATIONS

JPO machine translation of JP 09-216034, Aug. 19, 1997.*
International Search Report dated Sep. 8, 2009 issued in corresponding PCT Application No. PCT/JP2009/060878.
Chinese Office Action dated Aug. 2, 2012 issued in corresponding Chinese Application No. 200980121435.9 [with English Translation].

* cited by examiner

METHOD OF CASTING SEMI-LIQUID OR SEMI-SOLID IRON-BASED ALLOY AND DIE FOR CASTING

This application is a national stage application of International Application No. PCT/JP2009/060878, filed Jun. 15, 2009, which claims priority to Japanese Patent Application No. 2008-155991, filed on Jun. 13, 2008, the content of which is incorporated herein by reference.

BACKGROUND OF THE INVENTION

1. Field of the Invention

The present invention relates to a method of casting a semi-liquid or semi-solid iron-based alloy, and a die for casting, which is used for such casting.

Priority is claimed on Japanese Patent Application No. 2008-155991, filed on Jun. 13, 2008, the content of which is incorporated herein by reference.

2. Description of Related Art

There is a die-casting technique as a technique for producing large amounts of metal parts having complicated shapes. This technique is to force molten metal under high pressure into a die to solidify the molten metal, and is effective as a method of producing metal parts having a low melting point, such as aluminum-based alloys and magnesium-based alloys. However, since iron-based alloys have a high melting point and the same iron-based alloy is frequently used as a die material, the die-casting technique has not been widely used to produce iron-based alloy parts.

In recent years, a method has been developed and put into practice which pays attention to the high strength of steel to produce metal parts from semi-liquid cast iron by using the die-casting technique. In addition to this, the development of dies having sufficient durability has been desired. Meanwhile, conventionally, various techniques have been developed to improve the durability of the dies, which are used in die-casting or injection forming, focusing on the use of non-ferrous metals.

In particular, Japanese Unexamined Patent Application, First Publication No. 2004-114151 discloses a technique of performing a gas sulphonitriding treatment on the surface of a die to reduce the wettability of the surface of the die with respect to molten magnesium which is provided for die-casting or injection forming to thereby prevent seizure and improve the releasability of a cast product.

In addition, Japanese Unexamined Patent Application, First Publication No. 2001-232443 discloses a method of applying and drying a coating agent including particles such as fluorides, borides, carbides and carbonates, fats and oils, and organic metals on the surface of a die-casting die to form a coating having pores.

Japanese Unexamined Patent Application, First Publication No. 07-303933 discloses a technique of applying and drying a covering material, in which a powder such as an oxide and a fibrous material such as potassium titanate are dispersed in the water including sodium silicate, on the surface of a die for casting and performing a heating treatment for curing to conduct a covering treatment to thereby improve the durability of the die and the releasability of a cast product.

The temperature of semi-liquid cast iron is lower than the melting point of the cast iron. For example, the temperature of semi-liquid cast iron, in which the C content is 2.0%, is in the range of about 1200 to 1270° C., and is significantly higher than the melting point of an aluminum alloy or a magnesium alloy. In addition, the material which is frequently used in a die is die steel which is typified by SKD61. From these circumstances, a die is exposed to an environment, in which wear, seizure between the die and the cast product, cracks caused by thermal shock at the time of contact of the cast product, dissolution into the cast iron, and the like are significantly likely to occur. In fact, normal die-casting dies for an alloy of a low melting point withstand the production of more than ten thousand cast products. However, even when employing the techniques of Japanese Unexamined Patent Application, First Publication No. 2004-114151, No. 2001-232443, and No. 07-303933, current die-casting dies for semi-liquid cast iron have a durability limit corresponding to the production of about a thousand products. The die-casting dies for a semi-liquid cast iron have a short lifespan and an improvement in their durability is thus desired.

The present invention is contrived in view of these problems, and an object of the present invention is to provide a method of casting a semi-liquid or semi-solid iron-based alloy, in which wear at high temperatures in the inner surface of a die and seizure and corrosion caused by cast metal are prevented from occurring, and the durability is improved with good releasability in thixocasting (semi-liquid casting) and rheocasting (semi-solid casting) of an iron-based alloy (such as hypoeutectic cast iron), and a die for casting.

SUMMARY OF THE INVENTION

In order to achieve the object, the present inventor has extensively studied the coating material (release agent) which is applied to the die. Through the study, it was found that the following lubricating die-release agent has a large effect on the improvement in the durability of the die for casting an iron-based alloy in a semi-liquid or semi-solid state.

The present invention is achieved based on the above-described finding, and the main points thereof are as follows.

(1) A method of casting a semi-liquid or semi-solid iron-based alloy, the method including: applying, to a part or to the whole of an uppermost surface of an inner surface of a die, a lubricating die-release agent in which particles including at least one selected from molybdenum disulfide, graphite, tungsten disulfide, boron nitride, chrome oxide and boric oxide are dispersed in a solvent; and thereafter casting by using the die.

(2) The method of casting a semi-liquid or semi-solid iron-based alloy according to (1), the method further including: covering a part or the whole of a surface of a base member of the die with a film formed by at least one of spraying of a metal or a cermet, plating of a metal and deposition of a metal nitride or a metal carbonitride, wherein the lubricating die-release agent is applied to a surface of the film.

(3) The method of casting a semi-liquid or semi-solid iron-based alloy according to (1) or (2), wherein the solvent of the lubricating die-release agent is a synthetic ester oil, a silicon oil, a polyglycol, a polyacryl, an aqueous solution of a polyglycol or a polyacryl or an aqueous solution in which a surfactant is added to the aqueous solution.

(4) A die for casting which is used for semi-liquid casting or semi-solid casting of an iron-based alloy, wherein a lubricating die-release agent in which particles including at least one selected from molybdenum disulfide, graphite, tungsten disulfide, boron nitride, chrome oxide and boric oxide are dispersed in a solvent is applied to a part or to the whole of an uppermost surface of an inner surface of the die.

(5) The die for casting according to (4), wherein a part or the whole of a surface of a base member of the die for casting is covered with a film formed by at least one of spraying of a metal or a cermet, plating of a metal and deposition of a metal nitride or a metal carbonitride, and the lubricating die-release agent is applied to a surface of the film.

(6) The die for casting according to (4) or (5), wherein the solvent of the lubricating die-release agent is a synthetic ester oil, a silicon oil, a polyglycol, a polyacryl, an aqueous solution of a polyglycol or a polyacryl or an aqueous solution in which a surfactant is added to the aqueous solution.

Due to the present invention, the durability of a die is improved and roughly ten to twenty thousand cast products or more can be produced by one die without being modified or repaired. In addition, since the effects are exhibited by only applying a lubricating die-release agent between the respective shots, it is possible to reduce the care and replacement time for the die and improve production efficiency. Thus, the quality of a cast product of an iron-based alloy can be stabilized and the production cost can be reduced.

DETAILED DESCRIPTION OF THE INVENTION

Figure 1:
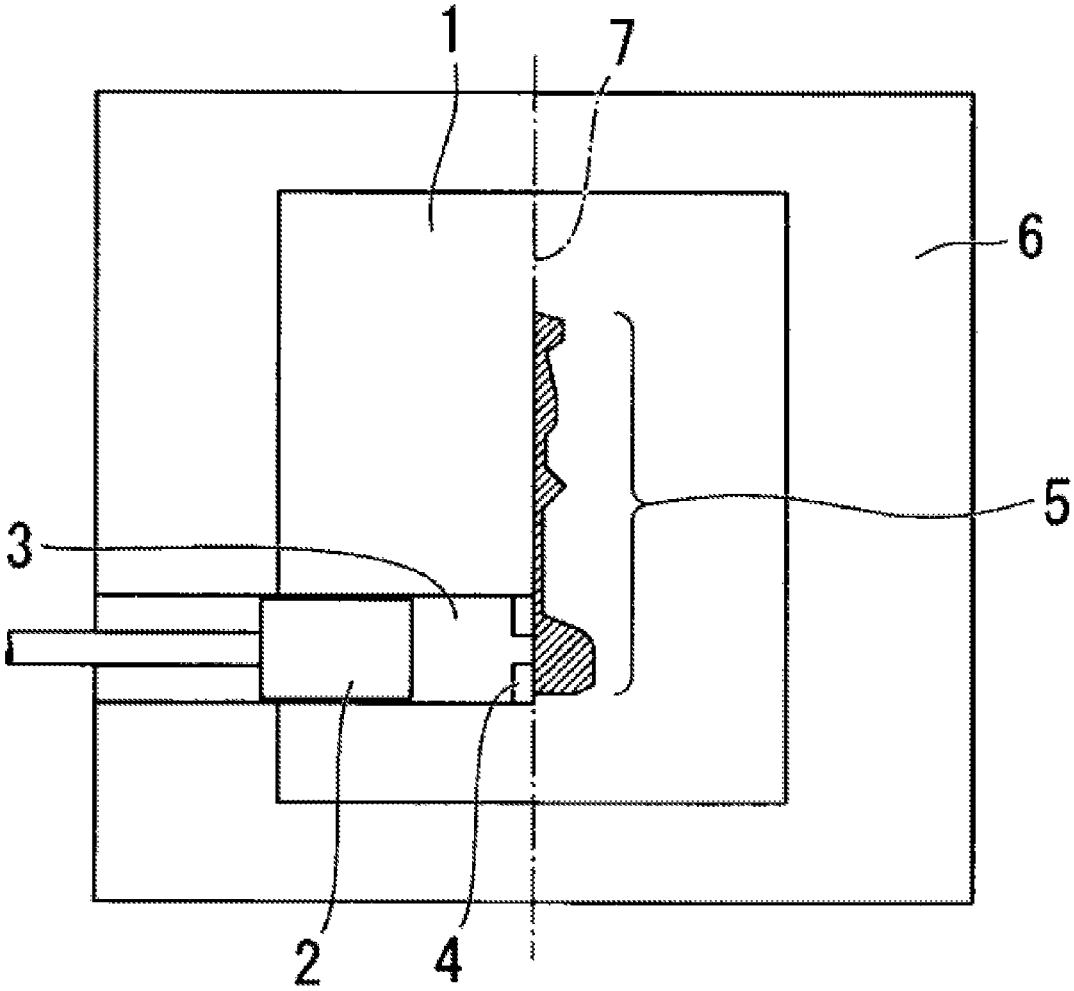
FIG. 1 (PRIOR ART)
FIG. 1 is a cross-sectional diagram showing a die for semi-liquid or semi-solid casting of an iron-based alloy.

Hereinafter, preferred embodiments of the present invention will be described with reference to the accompanying drawings in detail. In the present specification and drawings, constituent elements having substantially the same function and configuration are denoted by the same reference numerals and the redundant descriptions thereof is omitted.

FIG. 1 is a cross-sectional diagram showing an example of a die for casting an iron-based alloy, which is applied to the present invention. In the drawing, reference numeral 1 denotes a die, reference numeral 2 denotes a plunger, reference numeral 3 denotes an injection port, reference numeral 4 denotes a gate, reference numeral 5 denotes a cavity which is filled with a cast product, and reference numeral 6 denotes a die frame. The die 1 is installed in the die frame 6 and has a structure to be opened and closed by a separating surface 7.

In actual casting, an iron-based alloy casting material is heated to be semi-liquid or semi-solid and is then charged into the injection port 3. The cavity 5 is filled with the material by the plunger 2 via the gate 4, and immediately after that, the die 1 is opened by the separating surface 7 to remove the cast product.

As a material of the base member of the die, die steel which is typified by SKD61, high-speed tool steel, Cr heat-resistant steel, Ni—Cr heat-resistant steel, heat-resistant cast steel, a cemented carbide, a Ni alloy such as inconel 718, or a copper alloy such as copper, Be copper, and Cr—Zr copper is preferably used.

In the present invention, by applying a lubricating die-release agent, having seizure resistance with respect to an iron-based alloy, lubricity and a heat shielding property, to a part or to the whole of an inner surface constituted by the injection port 3 and the cavity 5 of the die 1, the improvement in durability of the die, the improvement in releasability and assurance of product accuracy are achieved.

Preferred materials for the lubricating die-release agent which is applied on the inner surface of the die and characteristics thereof are as follows.

a) Particles consisting of at least one selected from molybdenum disulfide, graphite, tungsten disulfide, boron nitride, chrome oxide and boric oxide of a particle diameter of 2 to 200 μm are dispersed in a solvent.

Among the components of the lubricating die-release agent, these particles act as a filler, a lubricant agent and a release agent, reduce thermal shock caused by the contact of a semi-liquid casting material to the inner surface of the die, and contribute to the reduction in friction and wear occurring by the flow of the semi-liquid material and the improvement in releasability after the completion of the casting. The above material exhibits a solid lubricating action, that is, a friction and wear reducing action without being oxidized or decomposed over short periods of time up to the temperature (in many cases, 1100 to 1400° C.) of a semi-liquid or semi-solid area of the iron-based alloy. When the particle diameter is smaller than 2 μm, the particles are not uniformly dispersed, cannot serve to form a stable film as the filler and are insufficient in thermal shock reducing action.

On the other hand, when the particle diameter is larger than 200 μm, the particles are precipitated in the solvent and are not uniformly dispersed. When the particles are locally agglomerated, the thickness of the film becomes nonuniform or surface roughness increases, so the form accuracy of a cast product is reduced.

b) As the solvent for the lubricating die-release agent, a synthetic ester oil, a silicon oil, a polyglycol, a polyacryl, an aqueous solution of a polyglycol or a polyacryl or an aqueous solution in which a surfactant is added to the aqueous solution, having a kinetic viscosity of $5\times10^{-6}$ to $5\times10^{-4}$ $m^2/s$, is used.

An oil-based or water-based material may be used as the material of the solvent. Among oil-based materials, mineral oil is associated with the risk of flammability to require a high casting temperature for an iron-based alloy, so a synthetic ester oil (such as a polyol ester) or a silicon oil which has a high flash point and is a material which undergoes minor evaporation is suitable to use. Among the water-based materials, a polyglycol or a polyacryl is suitable to use. A polyglycol or a polyacryl alone or in an aqueous solution exhibits an appropriate viscosity, and have the characteristic that they are evaporated stably without the occurrence of bumping when exposed to high temperatures. When the viscosity is lower than $5\times10^{-6}$ $m^2/s$, the adhesion to the inner surface of the die becomes weak, and the evaporation occurs so rapidly that the stable application cannot be performed. When the viscosity is higher than $5\times10^{-4}$ $m^2/s$, it is difficult to uniformly disperse the particles described in the paragraph a), and nonuniformity in the film thickness or sag occurs at the time of application, so a viscosity higher than $5\times10^{-4}$ $m^2/s$ cannot be applied to the die. In the present invention, the kinetic viscosity is a value which is measured at 40° C. In order to secure the kinetic viscosity in the above range, it is preferable that the concentration of a synthetic ester oil, a silicon oil, a polyglycol, or a polyacryl be equal to or higher than 70% by mass in the case of employing the material in the aqueous solution. When a surfactant is added to the aqueous solution, the kind and the additive amount of the surfactant are not particularly limited. However, from the viewpoint of the increase in dispersibility of solid particles, a nonionic surfactant (such as naphthalenesulphonate) is preferably used and the additive amount of the surfactant is preferably about 0.1% by mass with respect to the water.

The lubricating die-release agent is produced by dispersing the particles described in the paragraph a) in the solvent described in the paragraph b). A mixing amount of the particles in the solvent varies depending on the particle diameter and the viscosity of the solvent, and it is possible to mix the particles in the wide range of 1 to 90% by volume. The thickness of a coating which is formed by applying the lubricating die-release agent mixed in this manner varies depending on the particle diameter, and a preferable thickness is in the range of 5 to 150 μm. The lubricating die-release agent can be applied on the inner surface of the die by being sprayed or brushed over short time periods between the respective shots of die-casting. The lubricating die-release agent may be dried after application. However, in many cases, while the lubricating die-release agent is semi-dried for several to several tens of seconds by the residual heat of the die-casting, the next casting operation can be performed without any problems. As described above, since the solvent described in the paragraph b) is stably evaporated even at high temperatures at the time of the semi-liquid casting of an iron-based alloy, there is no hindrance accompanied with the danger in the operation and the quality of the cast product does not deteriorate. Further, since bubbles are formed in the film when the solvent is evaporated at a high temperature, a further thermal shock reducing effect on the inner surface of the die can be exhibited.

The above-described lubricating die-release agent has an excellent seizure resistance with respect to an iron-based alloy used as a casting material, an excellent lubrication property and an excellent heat shielding property reducing thermal shock with respect to the die base member, and exhibits excellent characteristics and releasability. Accordingly, when any of the above materials is used, a die is obtained having a durability corresponding to the continuous production of at least about ten to twenty thousand non-defective products in the semi-liquid or semi-solid casting of an iron-based alloy.

Preferred examples in which the lubricating die-release agent is applied on the inner surface of the die according to the present invention will be described based on the cross-sectional diagram of the die for casting an iron-based alloy, shown in FIG. 1. The region in which the lubricating die-release agent is applied is a part or the whole of the inner surfaces of the injection port 3, the gate 4 and the cavity 5. The lubricating die-release agent is typically applied only in the cavity 5 to obtain releasability. However, applying the lubricating die-release agent on the inner surfaces of the injection port 3 and the gate 4 is also effective in improving the lubricity of a sliding surface between the plunger 2 and the injection port 3 and the lubricity between a casting material and the gate 4. Meanwhile, the lubricating die-release agent may be applied only on the inner surfaces of the injection port 3 and the gate 4 to prevent the die from being worn. When the lubricating die-release agent is applied on the inner surfaces of the injection port 3 and the gate 4, a casting pressure reducing effect is also exhibited. In addition, in the die, the lubricating die-release agent may be directly applied without surface processing. However, the lubricating die-release agent may be applied on the inner surfaces to which surface processing employing any of spraying a metal or a cermet, plating and deposition is performed in order to improve wear resistance and reduce thermal shock. Generally, these surface processing are sometimes performed on the whole surfaces or only a part of surfaces of the injection port 3, the gate 4 and the cavity 5. In any case, the lubricating die-release agent of the present invention exhibits a lubrication effect and a release effect in the inner surface of the die.

Figure 2:
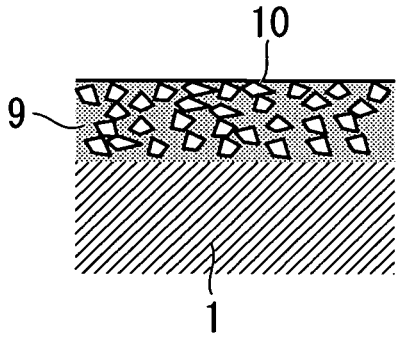
FIG. 2 is a schematic diagram showing the cross-section of a layer of a lubricating die-release agent which is applied on an inner surface of the die according to the present invention.
Figure 3:
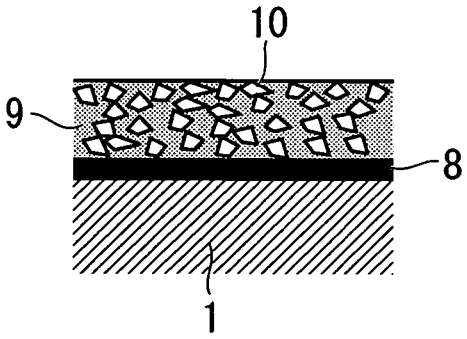
FIG. 3 is a schematic diagram showing the cross-section of a layer of a lubricating die-release agent which is applied on an inner surface of another die according to the present invention.

FIG. 2 is a schematic diagram showing the cross-section of a layer of the lubricating die-release agent which is applied on the inner surface of the die of the present invention, and FIG. 3 is a schematic diagram showing the cross-section of a layer of the lubricating die-release agent which is applied on the inner surface of the die of the present invention so as to be superimposed on the surface of a surface processing layer 8 formed by any of spraying a metal or a cermet, plating and deposition. When the lubricating die-release agent is applied between the respective shots of casting and is then semi-dried, the cross-sectional structure of the lubricating die-release agent is as shown in the drawing where particles 10 are dispersed in a solvent or a semi-dried or semi-solid layer 9 of the solvent. In many cases, the semi-dried or semi-solid layer 9 has fine pores formed by the action in which the vapor of the solvent is emitted by the residual heat at the time of casting, and is thus porous. Accordingly, the thermal shock reducing effect is improved, the flow and spread are easily achieved by the shear and the pressure received from the casting material at the time of casting, and the lubrication effect of the particles 10 is improved. Since such a covering layer structure is formed, the lubrication effect and the thermal shock reducing effect efficiently act on the wide area in the inner surface of the die with a small amount of the lubricating die-release agent.

EXAMPLES

Hereinafter, the present invention will be described in more detail by using examples.

Example 1

Figure 4:
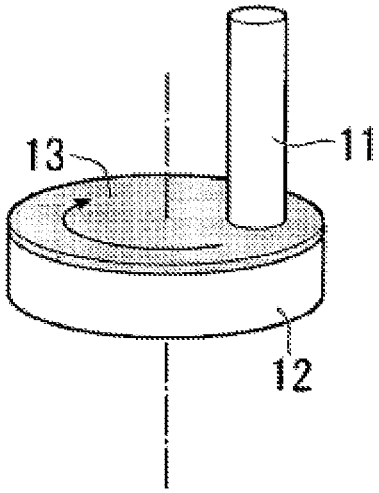
FIG. 4 (PRIOR ART)
FIG. 4 is a perspective view of an evaluation device which is used in Example 1.

The wear resistance and the seizure resistance of surfaces, on which the various lubricating die-release agents have been applied, with respect to an iron-based material in a hot condition were evaluated by using an evaluation device shown in FIG. 4. The device was a pin-on-disk type and the lubricating die-release agents were applied on the surface of a disk 12 by a spray. The thickness of a layer 13 of an applied lubricating die-release agent was in the range of 20 to 120 μm. The base member of the disk had the dimensions of diameter 50×thickness 10 mm, and die steel SKD61, heat-resistant steel SCH22, Ni alloy inconel 718 and Be copper were used as the material of the disk in accordance with test conditions. A pin 11 had the dimensions of diameter 5×length 20 mm and a hardened product of SKD61 having a hardness of an HRC of 48 to 50 was used as the material of the pin. The present test was performed for the purpose of evaluating the wear resistance and the seizure resistance of an iron-based alloy casting material such as cast iron and a die surface. However, die steel having a higher strength and hardness than that of cast iron was used as a material for the pin to promote the wear test. Since the cast iron and the die steel are the same iron-based material, the seizure resistance in general can also be evaluated in the same manner.

As the test conditions, the number of rotations was 500 r/m, a sliding rate of the pin and the disk was 0.92 m/s, a pressing load of the pin was 980 N, and an atmosphere temperature was 400° C.

Table 1 shows the results obtained by comparing the wear resistance and the seizure resistance of the various lubricating die-release agents according to the present invention with those of other materials using the above method and evaluating the wear resistance and the seizure resistance. Table 2 shows the components of the lubricating die-release agents used in the evaluation. The wear resistance was evaluated by detaching the disk tested for 30 minutes, observing the cross-section of a sliding surface between the disk and the pin and measuring the amount of thickness loss of the most worn part. The seizure resistance was evaluated by visually checking the presence or absence of the transfer of the material of the tip of the pin in the surface of the disk after the test and performing the cross-sectional observation. As a result of the evaluation, it was confirmed that all the dies of the present invention have an excellent wear resistance and seizure resistance. "Slight wear" in Table 1 indicates the surface property of the disk and expresses that no recognizable recesses, scratches or adhered matters (protrusions) are detected. In Table 2, a formaldehyde condensate of naphthalenesulfonate was used as a surfactant and 0.1% by mass of the surfactant was added with respect to water.

TABLE 1

Evaluation Results of Wear Resistance and Seizure Resistance

| No. | | Symbol of Material for Lubricating Die-Release Agent | Film Thickness (μm) | Material for Base Member of Disk | Disk Wear Amount (μm) | Presence or Absence of Seizure | References |
|---|---|---|---|---|---|---|---|
| 1 | Example | $WS_2$/PGW | 50 | SKD61 | 40 | Absence | Slight Wear |
| 2 | Example | $MoS_2$/PGW | 50 | SKD61 | 40 | Absence | Slight Wear |
| 3 | Example | Gr/PGW | 30 | SKD61 | 30 | Absence | Slight Wear |
| 4 | Example | BN/PGW | 20 | SKD61 | 20 | Absence | Slight Wear |
| 5 | Example | $Cr_2O_3$/PGW | 50 | SKD61 | 50 | Absence | Slight Wear |
| 6 | Example | $B_2O_3$/PGW | 50 | SKD61 | 50 | Absence | Slight Wear |
| 7 | Example | $WS_2$/PG | 70 | SKD61 | 30 | Absence | Slight Wear |
| 8 | Example | $WS_2$/PA | 100 | SKD61 | 30 | Absence | Slight Wear |
| 9 | Example | $WS_2$/PAW | 80 | SKD61 | 40 | Absence | Slight Wear |
| 10 | Example | $WS_2$/PE | 120 | SKD61 | 20 | Absence | Slight Wear |
| 11 | Example | $WS_2$/Si | 100 | SKD61 | 60 | Absence | Slight Wear |
| 12 | Example | $WS_2$/PGW + A | 50 | SKD61 | 30 | Absence | Slight Wear |
| 13 | Example | $WS_2$/PGW | 50 | SKH51 | 20 | Absence | Slight Wear |
| 14 | Example | $WS_2$/PGW | 50 | SCH22 | 20 | Absence | Slight Wear |
| 15 | Example | $WS_2$/PGW | 50 | Carbide | 10 | Absence | Slight Wear |
| 16 | Example | $WS_2$/PGW | 50 | Inconel 718 | 10 | Absence | Slight Wear |
| 17 | Example | $WS_2$/PGW | 50 | Be copper | 20 | Absence | Some Recesses in Sliding Part |
| 18 | Example | $WS_2$/PGW | 50 | SKD61 + CoCrAlY | 40 | Absence | Slight Wear |
| 19 | Example | $WS_2$/PGW | 50 | SKD61 + CrC/NiCr | 40 | Absence | Slight Wear |
| 20 | Example | $WS_2$/PGW | 50 | SKD61 + Ni—W | 40 | Absence | Slight Wear |
| 21 | Example | $WS_2$/PGW | 50 | SKD61 + CrN | 40 | Absence | Slight Wear |
| 22 | Example | $WS_2$ + $Cr_2O_3$/PGW | 50 | SKD61 | 40 | Absence | Slight Wear |
| 23 | Example | $MoS_2$ + BN/PGW | 50 | SKD61 | 25 | Absence | Slight Wear |
| 24 | Example | $Cr_2O_3$ + $B_2O_3$/PGW | 50 | SKD61 | 50 | Absence | Slight Wear |
| 25 | Comparative Example | None | — | SKD61 | More than 1 mm | Presence | Seizure Stop in about 5 Minutes |
| 26 | Comparative Example | None | — | SKD61 + CoCrAlY | About 300 | Presence | Some Scratches |
| 27 | Comparative Example | None | — | SKD61 Gas Sulphonitriding Treatment | 100 | Presence of Little Bit of Seizure | Some Scratches |
| 28 | Comparative Example | MgO/$Na_2SiO_3$ | 50 | SKD61 | 100 | Absence | Some Scratches |
| 29 | Comparative Example | ZSNY/$Na_2SiO_3$ | 100 | SKD61 | 90 | Absence | Slight Wear |

(Note 1)

Supplemental Explanation in Material for Base Member of Disk of No. 18 to No. 21

No. 18: SKD61 + CoCrAlY . . . Metal Spraying (Film Thickness 100 μm) by High-speed Gas Spraying Method No. 19: SKD61 + CrC/NiCr . . . Cermet Spraying (Film Thickness 100 μm) by High-speed Gas Spraying Method No. 20: SKD61 + Ni—W . . . Ni—W Alloy Plating (Film Thickness 50 μm)

No. 21: SKD61 + CrN . . . PVD Deposition Film of CrN (Film Thickness 3 μm)

(Note 2)

Supplemental Explanation in Material for Lubricating Die-Release Agents of No. 22 to No. 24, No. 28 and No. 29

No. 22: $WS_2$ + $Cr_2O_3$ . . . Particles in which particles of $WS_2$ and particles of $Cr_2O_3$ are mixed at a volume ratio of 50 to 50 are dispersed in a solvent.

No. 23: $MoS_2$ + BN . . . Particles in which particles of $MoS_2$ and particles of BN are mixed at a volume ratio of 80 to 20 are dispersed in a solvent.

No. 24: $Cr_2O_3$ + $B_2O_3$ . . . Particles in which particles of $Cr_2O_3$ and particles of $B_2O_3$ are mixed at a volume ratio of 60 to 40 are dispersed in a solvent.

No. 28: MgO/$Na_2SiO_3$ . . . Solution in which MgO is dissolved in a 10%-sodium silicate aqueous solution is applied and dried for 10 minutes by a hair dryer.

No. 29: ZSNY/$Na_2SiO_3$ . . . Material, in which 20% of potassium titanate fibers having an average diameter of 0.9 μm are mixed in a paste in which a mixture of $ZrO_2$, $SiO_2$, $NaAlO_2$ and $Y_2O_3$ is dissolved in a 22%-sodium silicate aqueous solution, is applied, dried, and then subjected to a heat treatment at 250° C. for 2 hours.

(Note 3)

Materials disclosed in Japanese Unexamined Patent Application, First Publication No. 2004-114151, No. 2001-232443, and No. 07-303933 are used in No. 27, No. 28, and No. 29, respectively.

TABLE 2

Symbol and Components of Lubricating Die-Release Agent

| No. | | Symbol of Material for Lubricating Die-Release Agent | Particle Material | Particle Diameter (μm) | Solvent Material | Solvent Viscosity (cSt) | Volume Content of Particles in Lubricating Die-Release Agent (%) |
|---|---|---|---|---|---|---|---|
| 1 | Example | $WS_2$/PGW | Tungsten Disulfide | 30 to 50 | Polyglycol 70 wt % + Water | 30 | 40 |
| 2 | Example | $MoS_2$/PGW | Molybdenum Disulfide | 20 to 30 | Polyglycol 70 wt % + Water | 30 | 30 |
| 3 | Example | Gr/PGW | Graphite | 100 to 200 | Polyglycol 70 wt % + Water | 30 | 20 |
| 4 | Example | BN/PGW | Boron Nitride | 10 to 35 | Polyglycol 70 wt % + Water | 30 | 20 |
| 5 | Example | $Cr_2O_3$/PGW | Chrome Oxide | 30 to 100 | Polyglycol 70 wt % + Water | 30 | 30 |
| 6 | Example | $B_2O_3$/PGW | Boric Oxide | 150 to 200 | Polyglycol 70 wt % + Water | 30 | 30 |
| 7 | Example | $WS_2$/PG | Tungsten Disulfide | 30 to 50 | Polyglycol 100% | 40 | 30 |
| 8 | Example | $WS_2$/PA | Tunsten Disulfide | 30 to 50 | Polyacryl 100% | 50 | 20 |
| 9 | Example | $WS_2$/PAW | Tungsten Disulfide | 30 to 50 | Polyacryl 80% + Water | 30 | 40 |
| 10 | Example | $WS_2$/PE | Tungsten Disulfide | 30 to 50 | Polyol Ester | 100 | 40 |
| 11 | Example | $WS_2$/Si | Tungsten Disulfide | 30 to 50 | Silicon Oil | 90 | 40 |
| 12 | Example | $WS_2$/PGW + A | Tungsten Disulfide | 30 to 50 | Polyglycol 70 wt % + Water + Surfactant | 30 | 50 |
| 13 | Example | $WS_2$/PGW | Tungsten Disulfide | 30 to 50 | Polyglycol 70 wt % + Water | 30 | 40 |
| 14 | Example | $WS_2$/PGW | Tungsten Disulfide | 30 to 50 | Polyglycol 70 wt % + Water | 30 | 40 |
| 15 | Example | $WS_2$/PGW | Tungsten Disulfide | 30 to 50 | Polyglycol 70 wt % + Water | 30 | 40 |
| 16 | Example | $WS_2$/PGW | Tungsten Disulfide | 30 to 50 | Polyglycol 70 wt % + Water | 30 | 40 |
| 17 | Example | $WS_2$/PGW | Tungsten Disulfide | 30 to 50 | Polyglycol 70 wt % + Water | 30 | 40 |
| 18 | Example | $WS_2$/PGW | Tungsten Disulfide | 30 to 50 | Polyglycol 70 wt % + Water | 30 | 40 |
| 19 | Example | $WS_2$/PGW | Tungsten Disulfide | 30 to 50 | Polyglycol 70 wt % + Water | 30 | 40 |
| 20 | Example | $WS_2$/PGW | Tungsten Disulfide | 30 to 50 | Polyglycol 70 wt % + Water | 30 | 40 |
| 21 | Example | $WS_2$/PGW | Tungsten Disulfide | 30 to 50 | Polyglycol 70 wt % + Water | 30 | 40 |
| 22 | Example | $WS_2 + Cr_2O_3$/PGW | Tungsten Disulfide + Chrome Oxide | 30 to 50 | Polyglycol 70 wt % + Water | 30 | 40 in Total |
| 23 | Example | $MoS_2$ + BN/PGW | Tungsten Dioxide + Boron Nitride | 10 to 50 | Polyglycol 70 wt % + Water | 30 | 30 in Total |
| 24 | Example | $Cr_2O_3 + B_2O_3$/PGW | Chrome Oxide + Boric Oxide | 50 to 200 | Polyglycol 70 wt % + Water | 30 | 30 in Total |
| 25 | Comparative Example | None | — | — | — | — | — |
| 26 | Comparative Example | None | — | — | — | — | — |
| 27 | Comparative Example | None | — | — | — | — | — |
| 28 | Comparative Example | MgO/$Na_2SiO_3$ | Magnesium Oxide | 10 to 30 | Sodium Silicate 10 wt % + Water | 15 | 50 |
| 29 | Comparative Example | ZSNY/$Na_2SiO_3$ | Zirconium Oxide, Silicon Oxide, Sodium Aluminate, Yttria | 10 to 30 | Sodium Silicate 22 wt % + Water | 20 | 85 in Total |

Example 2

Figure 5:
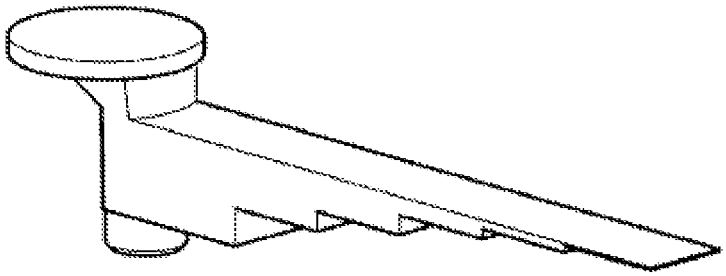
FIG. 5 (PRIOR ART)
FIG. 5 is a perspective view showing the shape of a cast product of Example 2.

Next, a lubricating die-release agent was applied on an actual test die for die-casting to obtain an aspect of the die of the present invention, and then a semi-liquid iron-based alloy was cast and formed. The shape of a trial cast product is shown in FIG. 5. The cast product shown in the drawing has a stair-like shape for the purpose of evaluating the shape formability of the iron-based alloy, that is, the flow property into a cavity. The thicknesses from the thickest part are sequentially 25 mm, 15 mm, 10 mm, 5 mm, 2.5 mm and 1 mm.

Table 3 shows the results obtained by casting a semi-liquid iron-based alloy using the die according to the present invention under various conditions and evaluating the shape formability and the durability of the die. The material of the used iron-based alloy is cast iron including C of 2.4% by mass, Si of 1% by mass, and impurities. The shape of the material was a cylindrical shape having a diameter of 50 mm and a height of 50 mm and the preheating temperature for the casting material was 1250° C. The temperature was increased from room temperature to the preheating temperature within 15 minutes and the holding time was 3 to 5 minutes. A hardened and tempered product of SKD61 having a hardness of an HRC of 45 to 47 was used as the material of the base member of the die. The preheating and the heat retention of the die are performed using an electric heater and the temperature of the die before casting was controlled so as to be in the range of 250 to 300° C. in the inner surface of a cavity.

Plural devices for preheating the material were installed and the casting was then started. Actual 1-shot die-casting was completed in 1 to 2 seconds, and the idle time from when a cast product was taken out to when the next material was charged into the die was in the range of about 30 seconds to 5 minutes. The lubricating die-release agent was applied to the inside of the die by being air-sprayed for about 15 to 30 seconds before the start of the next shot. The thickness of the film formed by applying the lubricating die-release agent was in the range of 20 to 150 μm at the time of drying.

The shape formability was evaluated by the inflow thickness of the stair-like part of the cast product. Regarding the durability of the die, the worn state of the inside of the die after casting of a certain number of shots was visually observed. As a result of the evaluation, it was confirmed that all the dies of the present invention, on which the lubricating die-release agent was applied, had excellent wear resistance and seizure resistance, could perform the casting of ten to twenty thousands times without being replaced and had improved shape formability due to the reduction of the wear between the die and the casting material.

Table 3

Results of Casting and Forming of Iron-Based Alloy

TABLE 3

| No. | | Symbol of Used Lubricating Die-Release Agent (The same as Table 2) | Thickness of Applied Material (μm) (Note 1) | Speed of Plunger (mm/s) | Formability (Note 2) | The Number of Times of Non-defective Product Casting | State of Inner Surface of Die After Casting |
|---|---|---|---|---|---|---|---|
| 1 | Example | $WS_2$/PGW | 30 | 120 | 1 mm | 16000 | Good without Scratch and Wear |
| 2 | Example | $MoS_2$/PGW | 20 | 150 | 1 mm | 20000 | Good without Scratch and Wear |
| 3 | Example | Gr/PGW | 110 | 150 | 1 mm | 20000 | Good without Scratch and Wear |
| 4 | Example | BN/PGW | 15 | 150 | 1 mm | 23000 | Good without Scratch and Wear |
| 5 | Example | $Cr_2O_3$/PGW | 30 | 80 | 2.5 mm | 15000 | Good without Scratch and Wear |
| 6 | Example | $B_2O_3$/PGW | 150 | 80 | 2.5 mm | 15000 | Good without Scratch and Wear |
| 7 | Example | $WS_2$/PE | 30 | 120 | 1 mm | 20000 | Good without Scratch and Wear |
| 8 | Example | $WS_2$/Si | 30 | 100 | 2.5 mm (up to mid-flow of 1 mm) | 12000 | Good. Excellent Product Shape |
| 9 | Example | $WS_2$/PGW + A | 30 | 120 | 1 mm | 18000 | Good |
| 10 | Comparative Example | None | — | 100 | 5 mm | 1000 | Large Gate Wear and Presence of Seizure |

(Note 1)

Thickness of Applied Material: The thickness is not measured every time. However, the thickness is measured and confirmed before the start of the casting and after about ten thousand shots in a dried state.

(Note 2)

Formability: The smallest thickness of a stair-like part of a cast product which could be actually formed. There is no practical problem if the alloy flows to form a thickness of up to 2.5 mm.

As described above, the preferred embodiments of the present invention have been described with reference to the accompanying drawings. However, needless to say, the present invention is not limited only to such examples. It is evident that those skilled in the technique can conceive various changed or modified examples in the category described in the claims and it is understood that the examples belong to the technical scope of the present invention definitely.

As described above, a die for semi-liquid or semi-solid casting of an iron-based alloy according to the present invention can be widely applied to die-casting from a semi-liquid or semi-solid state of the iron-based alloy. The present invention improves the durability life of the die, prevents the seizure between the material and the die to thereby obtain an effect of promoting releasability, and contributes to the improvement in the casting operation, such as the reduction in production cost, an improvement in the productivity and an improvement in the quality and form accuracy of a cast product.

DESCRIPTION OF REFERENCE NUMERALS AND SIGNS

1: DIE
2: PLUNGER
3: INJECTION PORT
4: GATE
5: CAVITY
6: DIE FRAME
7: DIE SEPARATING SURFACE
8: SURFACE PROCESSING LAYER
9: SOLVENT OR SEMI-DRIED OR SEMI-SOLID LAYER OF SOLVENT
10: PARTICLE
11: PIN
13: LUBRICATING DIE-RELEASE AGENT LAYER

What is claimed is:

1. A method of casting a semi-liquid or semi-solid iron-based alloy, the method comprising:

applying, to a part of an uppermost surface of an inner surface of a die between shots of die-casting, a lubricating die-release agent in which particles having a particle diameter of more than 30 μm and 200 μm or less and including at least one selected from molybdenum disulfide, graphite, tungsten disulfide, boron nitride, chrome oxide and boric oxide are dispersed in a solvent having a kinetic viscosity of $5\times10^{-6}$ to $4\times10^{-5}$ $m^2/s$ at 40° C.; and thereafter casting by using the die, wherein a volume content of the particles in the lubricating die-release agent is 30 to 90%, wherein the die includes:

an injection port;

a gate; and a cavity, wherein the lubricating die-release agent is applied on inner surfaces of the injection port and the gate but not on inner surfaces of the cavity.

2. The method of casting a semi-liquid or semi-solid iron-based alloy according to claim 1, the method further comprising:

covering a part or the whole of a surface of a base member of the die with a film formed by at least one of spraying of a metal or a cermet, plating of a metal and deposition of a metal nitride or a metal carbonitride, wherein the lubricating die-release agent is applied to a surface of the film.

3. The method of casting a semi-liquid or semi-solid iron-based alloy according to claim 1 or 2, wherein the solvent of the lubricating die-release agent is a synthetic ester oil, a silicon oil, a polyglycol, a polyacryl, an aqueous solution of a polyglycol or a polyacryl or an aqueous solution in which a surfactant is added to the aqueous solution.

4. The method of casting a semi-liquid or semi-solid iron-based alloy according to claim 1, wherein a thickness of a coating formed by applying the die-release agent is in a range of 5 to 150 μm.

5. The method of casting a semi-liquid or semi-solid iron-based alloy according to claim 1, wherein a diameter of the particles is 50 to 200 μm.

* * * * *

UNITED STATES PATENT AND TRADEMARK OFFICE

CERTIFICATE OF CORRECTION

PATENT NO. : 9,022,093 B2
APPLICATION NO. : 12/737123
DATED : May 5, 2015
INVENTOR(S) : Yoshiaki Shia It is certified that error appears in the above-identified patent and that said Letters Patent is hereby corrected as shown below:

Title page

Item (73) Assignee, change "Nippon Steel & Sumitomo Corporation, Tokyo (JP)" to

-- Nippon Steel & Sumitomo Metal Corporation, Tokyo (JP) --; and

Specification

Column 13, lines 31-33, change

"11: PIN

13: LUBRICATING DIE-RELEASE AGENT LAYER" to

-- 11: PIN

12: DISK

13: LUBRICATING DIE-RELEASE AGENT LAYER --.

Signed and Sealed this
Third Day of November, 2015

Michelle K. Lee

Michelle K. Lee
*Director of the United States Patent and Trademark Office*